US010556788B2

(12) United States Patent
Alletto et al.

(10) Patent No.: US 10,556,788 B2
(45) Date of Patent: Feb. 11, 2020

(54) PILLOW FILL MACHINE

(71) Applicant: Bedgear, LLC, Farmingdale, NY (US)

(72) Inventors: Eugene Alletto, Glen Head, NY (US); Evan Spelger York, Charlotte, NC (US)

(73) Assignee: BEDGEAR, LLC, Farmingdale, NY (US)

( * ) Notice: Subject to any disclaimer, the term of this patent is extended or adjusted under 35 U.S.C. 154(b) by 193 days.

(21) Appl. No.: 15/784,541

(22) Filed: Oct. 16, 2017

(65) Prior Publication Data

US 2019/0112179 A1 Apr. 18, 2019

(51) Int. Cl.
*B68G 7/06* (2006.01)
*B68G 1/00* (2006.01)

(52) U.S. Cl.
CPC ..... *B68G 7/06* (2013.01); *B68G 1/00* (2013.01); *B68G 2001/005* (2013.01)

(58) Field of Classification Search
CPC ..... B68G 7/06; B68G 2001/005; B65B 1/16; D01G 21/00
USPC ..... 141/67
See application file for complete search history.

(56) References Cited

U.S. PATENT DOCUMENTS 4,527,306 A * 7/1985 Thannheiser ..... D01G 23/08 19/105
5,359,753 A * 11/1994 Leifeld ..... A01D 90/08 19/80 R
2008/0209688 A1* 9/2008 Palmer ..... B68G 1/00 19/145.5

FOREIGN PATENT DOCUMENTS

CN 201003083 Y * 1/2008
CN 108516517 A * 9/2018

* cited by examiner

*Primary Examiner* — Timothy P. Kelly
(74) *Attorney, Agent, or Firm* — Sorell, Lenna & Schmidt, LLP

(57) ABSTRACT

A filling system includes a first component having a fiber opener configured to open fibers. A second component is connected to the first component. The second component includes a fiber blower configured to blow opened fibers. A third component is connected to the second component. The third component includes a weighing system configured to weigh the opened fibers. A fourth component is connected to the third component. The fourth component includes a filler configured to dispose the opened fibers into a shell. Methods of use are disclosed.

20 Claims, 11 Drawing Sheets

PILLOW FILL MACHINE

TECHNICAL FIELD

The present disclosure generally relates to fill machines, and more particularly to machines used to fill pillows with one or more material.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Pillows may be filled with a variety of materials to allow the pillow to provide the proper amount of cushioning so a sleeper can achieve proper sleep. Some pillows are filled with a combination of materials. The materials are fed into a machine where they are weighed and mixed so that the mix that fills the pillow includes selected amounts of each material. The machine uses air to transfer the mix from a distribution hopper, through various feed lines, to a filler. However, conventional machines are typically unable to accurately weight the materials that make up the mix, thus resulting in mixes that include different amounts of each material. Furthermore, conventional machines are typically unable to move the mix through the machine efficiently, thus causing the mix to get clogged within the machine. This disclosure describes an improvement over these prior art technologies.

SUMMARY

In one embodiment, in accordance with the principles of the present disclosure, a filling system is provided that includes a first component having a fiber opener configured to open fibers. A second component is connected to the first component. The second component includes a fiber blower configured to blow opened fibers. A third component is connected to the second component. The third component includes a weighing system configured to weigh the opened fibers. A fourth component is connected to the third component. The fourth component includes a filler configured to dispose the opened fibers that were weighed by the weighing system into a shell

BRIEF DESCRIPTION OF THE DRAWINGS

The present disclosure will become more readily apparent from the specific description accompanied by the following drawings, in which.

DETAILED DESCRIPTION

Figure 1:
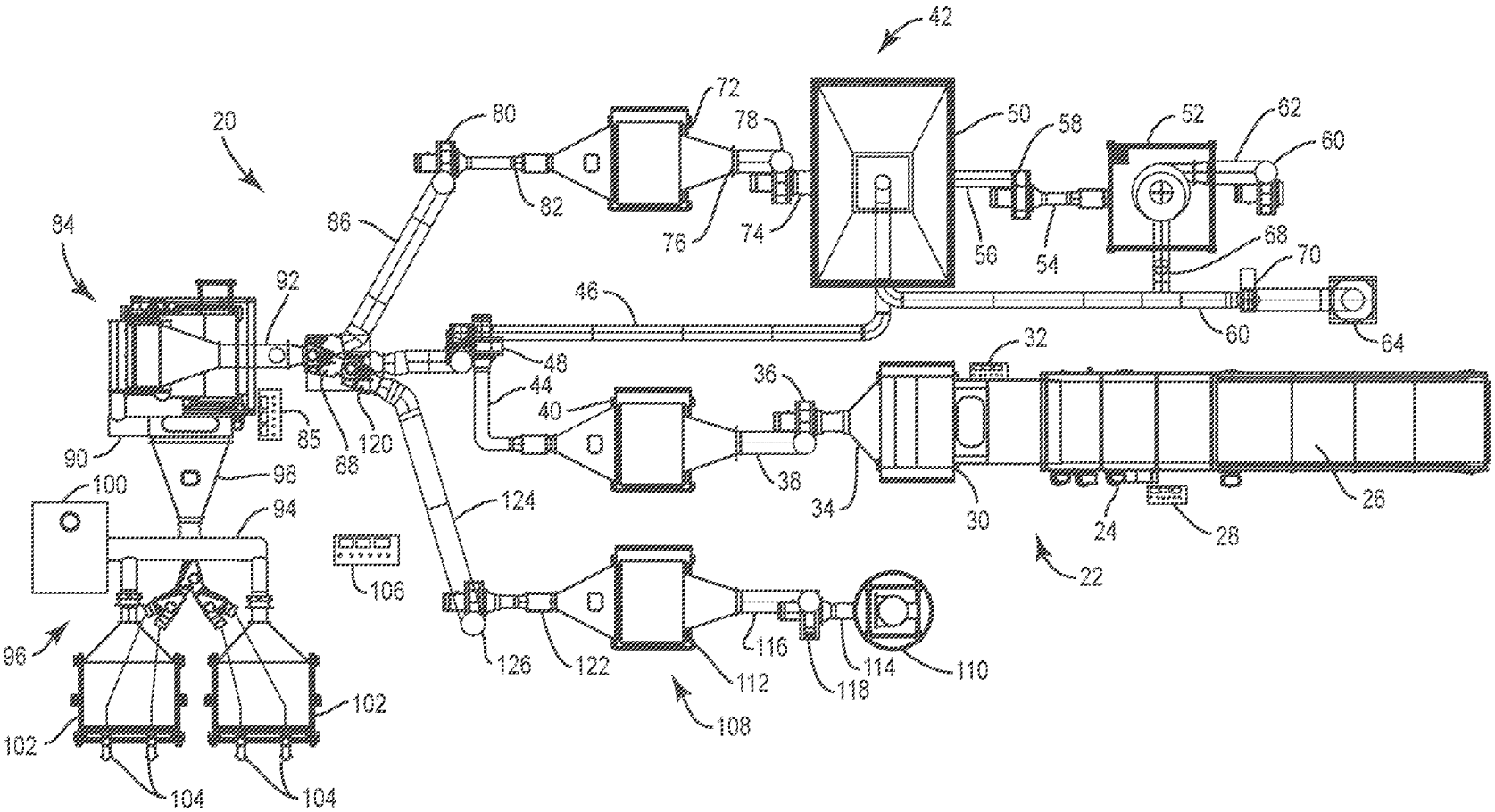
FIG. 1 is a top view of one embodiment of a filling system in accordance with the present principles of the present disclosure.

The exemplary embodiments are discussed in terms of fill machines, such as, for example, machines used to fill pillows with one or more material. The present disclosure may be understood more readily by reference to the following detailed description of the disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a pillow filling system 20. Alternate embodiments are also disclosed. Reference will now be made in detail to the exemplary embodiments of the present disclosure.

The components of pillow filling system 20 can be fabricated from materials including metals, synthetic polymers, ceramics and/or their composites, depending on the particular application and/or preference. For example, the components of system 20, individually or collectively, can be fabricated from materials such as stainless steel alloys, aluminum, commercially pure titanium, titanium alloys, Grade 5 titanium, super-elastic titanium alloys, cobalt-chrome alloys, stainless steel alloys, superelastic metallic alloys (e.g., Nitinol, super elasto-plastic metals, such as GUM METAL® manufactured by Toyota Material Incorporated of Japan), ceramics, thermoplastics such as polyaryletherketone (PAEK) including polyetheretherketone (PEEK), polyetherketoneketone (PEKK) and polyetherketone (PEK), carbon-PEEK composites, PEEK-$BaSO_4$ polymeric rubbers, polyethylene terephthalate (PET), fabric, silicone, polyurethane, silicone-polyurethane copolymers, polymeric rubbers, polyolefin rubbers, hydrogels, semi-rigid and rigid materials, elastomers, rubbers, thermoplastic elastomers, thermoset elastomers, elastomeric composites, rigid polymers including polyphenylene, polyamide, polyimide, polyetherimide, polyethylene, and epoxy. Various components of system 20 may have material composites, including the above materials, to achieve various desired characteristics such as strength, rigidity, elasticity, compliance, mechanical performance, durability and radiolucency or imaging preference. The components of system 20, individually or collectively, may also be fabricated from a heterogeneous material such as a combination of two or more of the above-described materials. The components of system 20 may be monolithically formed, integrally connected or include fastening elements and/or instruments, as described herein.

In some embodiments, system 20 is used to fill a pillow shell with one or more materials, such as, for example, conjugate hollow siliconized polyester fiber, hollow siliconized polyester fiber, down-like polyester fiber, 0.7 D-15 D or 32 MM-64 MM materials, and/or recycled foam. In some embodiments, system 20 is used to fill a pillow shell with one or more materials, such as, for example, one or more of the materials disclosed in U.S. Patent Application No. 62/533,920, which is incorporated by reference herein, in its entirety.

In some embodiments, system 20 includes a fiber opening machine, a foam shredder, an electrical weighing chamber and weighing system and a vacuum filling system. System 20 is configured to be can be handled by only one operator. In some embodiments, system 20 is controlled by a program, such as, for example, the Siemens PLC program. The filling weight can be controlled by the electrical weighing system with a high degree of accuracy. Using the vacuum filling system prevents fibers or other materials from escaping into the working shop to keep the shop clean.

In some embodiments, system 20 includes a bale breaker. The bale breaker is mainly used to load one or more bales of raw fiber material. The feeding quantity is adjustable by a photo cell. In some embodiments, the bale breaker has a working width of about 1200 mm and has a capacity of at least about 600 kg/h.

In some embodiments, system 20 includes a fiber opening machine. The fiber opening machine is able to be used for both down-like fiber and regular fiber. The fiber opening machine may include a motor circuit detection relay to prevent a motor of the fiber opening machine from being broken if the fiber opening machine gets stuck. In some embodiments, the fiber opening machine includes an electrical metal alarm system that detects if metal enters the fiber opening machine and/or stops the machine if metal enters the fiber opening machine.

In some embodiments, system 20 includes a fiber distributor and metal separator. The fiber distributor includes an aluminum blower blade with dynamic balance process. The metal separator is used to catch up metal and needles while combing through a duct after the fill material moves out of the fiber opening machine.

In some embodiments, system 20 includes an electrical weighing mixer. Different material can be mixed by the electrical weighing mixer with an adjustable mixing ratio and weight. The electrical weighing mixer can be used to mix two or more different materials. The electrical weighing mixer is configured to achieve a uniform mixing quality.

In some embodiments, system 20 includes a silo that is used to keep enough material after mixing so that the material is ready for the next program as soon as a signal is received from the filling system.

In some embodiments, system 20 includes an electrical weighing system. The electrical weighing system can be used for both single opening fiber and ball fiber. The finished fiber can be loaded into a vibration hopper on top of the load cell with a separated frame without affecting the load cell accuracy. The material can drop down to the top box, which will hold the material for a selected length of time, and then drop to the load cell, where the material is weighed. As soon as a target fiber quantity is in the load cell, the material will be moved into a vacuum filling system.

In some embodiments, system 20 includes a vacuum filling system that includes two vacuum filling cabinets that are positioned next to the weighing system. The cabinets each include two nozzles. The vacuum filling system can fill a 600*g* pillow within seven seconds.

In some embodiments, system 20 includes a perforated airflow reducer that is designed to increase airflow required for high density materials, such as, for example, one or more of the materials discussed herein. The perforated airflow reducer may include an airflow adjustment sleeve. The perforated airflow reducer is configured to allow greater airflow by pulling ambient air into the system, without allowing material to escape.

In some embodiments, system 20 includes an auxiliary air supply. Due to the large volume of a reducer of system 20, system 20 would not be able to generate enough air flow to pneumatically convey materials, such as, for example, one or more of the materials discussed herein, without an auxiliary air supply. Using the existing airlines attached to a shutter on a silo 2 of system 20, bursts of air will loosen the material or materials enough to adequately convey the material or materials to the next phase of system 20.

In some embodiments, system 20 includes an auxiliary air supply for fiber. Pneumatic conveyance generates static electricity in fiber, causing the fiber to cling to plexiglass near a photo eye on a silo of system 20 even if the silo is not full. Material will not flow into the silo if the photo eye is blocked. An existing air supply was thus tapped to blow residual fiber clinging to the plexiglass away from the photo eye to allow material to flow when not truly full.

In some embodiments, system 20 includes a perforated transfer gate. Below a mixing system of system 20, where materials, such as, for example, one or more of the materials discussed herein are mixed, the transfer gate must generate enough air flow to move the material to the next phase. The perforated transfer gate provides may air flow panels made of plexiglass. In some embodiments, one or more of the panels is perforated. Existing airlines were tapped to break up material to allow the material to freely flow.

In some embodiments, system 20 includes a mixing system having at least one flex pipe. The mixing system is designed to accurately weigh materials to mix selected blends to the specific ratios. In order to get the most accurate weighing capabilities, the mixing system must not have any external forces that causes an inaccurate reading. Therefore, the mixing system must be suspended freely and independently above the load cells to achieve accuracy. To achieve this, the flex-pipe(s) are used to reduce the forces acting on the mixing system. This results in an independently floating mixing system atop the load cells to accurately mix materials, such as, for example, one or more of the materials discussed herein.

In some embodiments, system 20 includes a mixing system dispenser that includes lengthened flaps with nylon sheets and reinforced metal to capture all of the material within the dispenser and dispense it into the transfer gate without damaging the interior of the mixing system.

In some embodiments, system 20 includes a load cell information transfer. Certain materials, such as, for example, micro fiber, memory foam, latex foam and/or one or more of the materials discussed herein generate large amounts of static electricity. This electrostatic charge can have unwanted effects on the accuracy of the information being transferred to a weighing instrument. A ground wire was thus added to the load cell below the mixing system to discharge any electrostatic charge, and send accurate information to the instrument panel.

Figure 2:
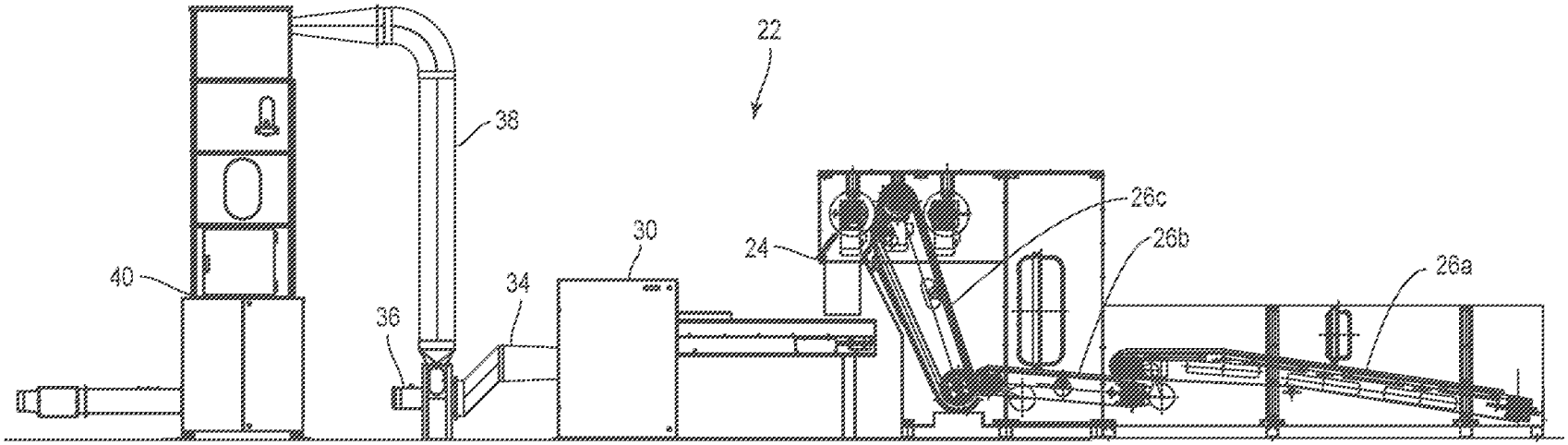
FIG. 2 is a side view of components of the filling system shown in FIG. 1.
Figure 3:
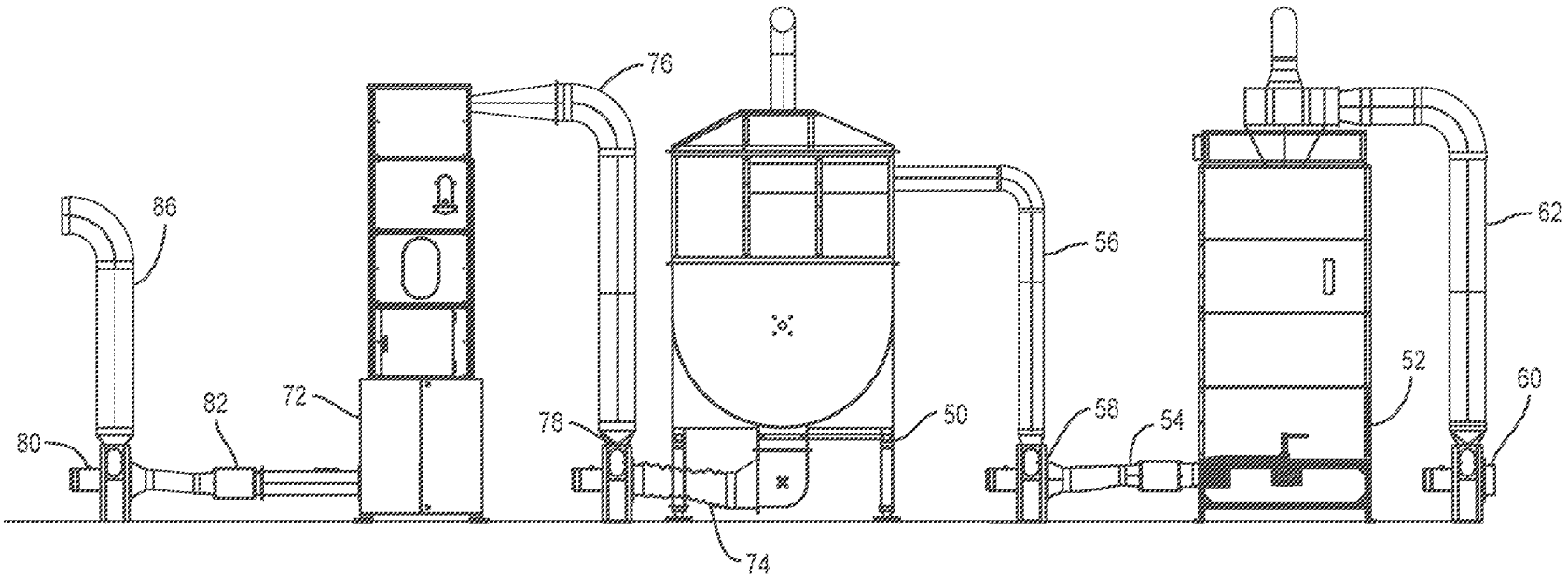
FIG. 3 is a side view of components of the filling system shown in FIG. 1.
Figure 4:
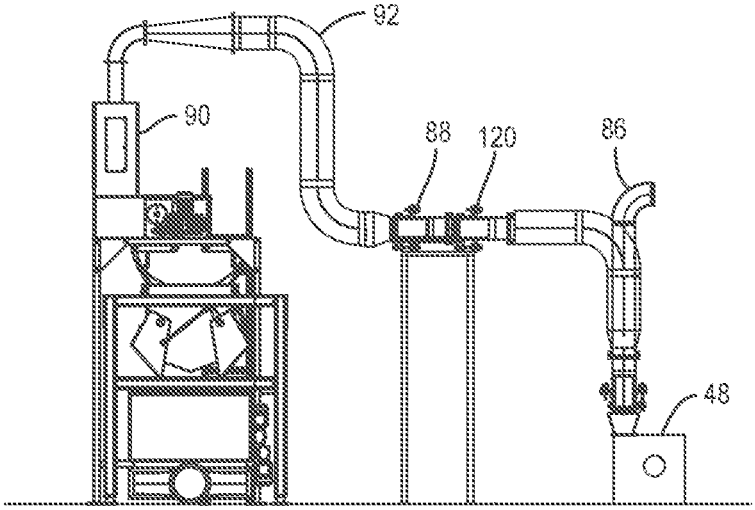
FIG. 4 is a side view of components of the filling system shown in FIG. 1.

System 20 includes a component 22 comprising a bale breaker, such as, for example, a bale opener 24 and a conveyor belt 26. One or more bales of fibers, such as, for example, compressed fibers of a first material may be placed on conveyor belt 26. Conveyor belt 26 moves the bale or bales to bale opener 24, which opens the bale or bales. In some embodiments, conveyor belt 26 includes a first conveyor belt 26*a*, a second conveyor belt 26*b* and a third conveyor belt 26*c*, as best shown in FIG. 2. Conveyor belt 26*b* is positioned between conveyor belt 26*a* and conveyor belt 26*c*. The bale or bales is/are initially loaded onto conveyor belt 26*a*, which moves the bale or bales to conveyor belt 26*b*. Conveyor belt 26*b* moves the bale or bales to bale opener 24. Conveyor belt 26*a* extends parallel or substantially parallel to conveyor belt 26*b* and conveyor belt 26*c* extends transverse to conveyor belts 26*a*, 26*b* in order to move the bale or bales upwardly relative to conveyor belt 26*b* such that the bale or bales moves/move to bale opener 24, which is positioned above conveyor belts 26*a*, 26*b*, 26*c*. In some embodiments, component 22 includes one or more photo cells to adjust the feeding quantity. That is, component 22 may include one or more photo cells that detect if a bale is on conveyor belt 26. If the photo cell detects that a bale is on conveyor belt 26, the photo cell will send a signal to rotate conveyor belt 26 such that conveyor belt 26 moves the bale to bale opener 24. If the photo cell does not detect that a bale is on conveyor belt 26, the photo cell will send a signal to stop conveyor belt 26 from rotating. In some embodiments, component 22 includes an electrical cabinet 28 that includes electronic components that communicate with bale opener 24. In some embodiments, electrical cabinet 28 includes a circuit overload that communicates with an electrical cabinet 106, as discussed herein. If electrical cabinet 106 detects a problem in system 20, an operator may check electrical cabinet 28 to see if the problem is within component 22 or within another component of system 20. In some embodiments, the first material comprises a fiber material, such as, for example, micro fiber and/or one or more of the materials discussed herein.

The opened bale or bales move from bale opener 24 to a fiber opener, such as, for example, fine fiber opener 30, which opens the compressed fibers. In some embodiments, fine fiber opener 30 includes a first barrel and a second barrel rotatably positioned within the first barrel. The second barrel may include a plurality of hooks that are configured to pull the compressed fibers apart as the second barrel rotates within the first barrel. In some embodiments, component 22 includes an electrical cabinet 32 that includes electronic components that communicate with fiber opener 30. In some embodiments, electrical cabinet 32 includes a circuit overload that communicates with electrical cabinet 106, as discussed herein. If electrical cabinet 106 detects a problem in system 20, an operator may check electrical cabinet 32 to see if the problem is within fine fiber opener 30 or within another component of system 20. A funnel 34 is connected with fiber opener 30, as shown in FIGS. 1 and 2. A fiber blower 36 is connected with funnel 34. Fiber blower 36 includes a fan or blower configured to draw the opened fibers through funnel 34 and move the opened fibers through a tube, such as, for example, a duct 38 and into a silo 40 that is in communication with duct 38. In some embodiments, silo 40 includes a photo eye configured to sense when silo 40 is full and an air supply configured to blow the opened fibers away from the photo eye when silo 40 is not full, as discussed herein.

Silo 40 of component 22 is connected to a component 42 of system 20 by a tube, such as, for example, a duct 44 and a tube, such as, for example, a duct 46, as shown in FIG. 1. A fiber blower 48 is positioned between duct 44 and duct 46. Fiber blower 48 includes a fan or blower configured to draw the opened fibers through duct 44 and move the opened fibers through duct 46 and into an electrical mixer, such as, for example, a mixer 50 of component 42.

Component 42 includes a silo 52 that is connected to mixer 50 by ducts 54, 56. A fiber blower 58 is positioned between duct 54 and duct 56. Fiber blower 58 includes a fan or blower configured to draw a second material, such as, for example, foam in silo 52 through duct 54 and move the second material through duct 56 and into mixer 50. In some embodiments, component 42 includes a blower 60 that is connected to silo 52 by a duct 62. Blower 60 includes a fan or blower. In some embodiments, a device, such as, for example, a granulator or grinder may be attached to blower 60 such that chunks of material, such as, for example, foam may be moved from the granulator/grinder to silo 52 by blower 60. In some embodiments, an end of duct 54 that is connected to fiber blower 58 includes perforations configured to pull ambient air into system 20 without allowing the second material to escape, as discussed herein. In some embodiments, the end of duct 54 that is connected to fiber blower 58 includes an airflow adjustment sleeve configured to change the amount of the perforations that are exposed to ambient air to control the amount of ambient air that is pulled into duct 54, as discussed herein. In some embodiments, mixer 50 may include one more sensors to determine when mixer 50 is full and when mixer 50 is not full. System 20 can be configured to send a signal from mixer 50 to silo 40 and/or silo 52 to prevent more material being sent to mixer 50 when mixer 50 is full. System 20 may also be configured to send a signal from mixer to silo 40 and/or silo 52 so that more material to be sent to mixer 50 when mixer 50 is not full. For example, system 20 may turn fiber blower 48 and/or fiber blower 58 off when mixer 50 is full and may turn fiber blower 48 and/or fiber blower 58 on when mixer 50 is not full. In some embodiments, system 20 can be configured to send a signal from mixer 50 to silo 40 and/or silo 52 to send a selected amount of material within silo 40 to mixer 50 and a selected amount of material within silo 52 to mixer 50 when mixer 50 is not full so that mixer 50 will be filled with a certain percentage of the material from silo 40 and a certain percentage of the material from silo 52. This allows an operator to create a blend of materials using mixer 50 wherein the blend can have selected amounts of different materials.

In some embodiments, component 42 includes dust collectors 64 that are configured to remove dust from system 20. Dust collectors 64 are connected to silo 52 by a tube, such as, for example, a duct 66 and a tube, such as, for example, a duct 68 to remove dust from silo 52. A blower 70 is positioned between dust collectors 64 and duct 68. Blower 70 includes a fan or blower configured to move dust in silo 52 to blower 70. In some embodiments, the second material comprises memory foam, latex foam and/or one or more of the materials discussed herein.

Once the first material and the second material are disposed within mixer 50, mixer 50 can mix the materials. In some embodiments, mixer 50 includes a large axle positioned lengthwise within mixer 50. The axle has metal fabricated arms and brackets that mix the materials. The arms may be put into motion with an electric motor automatically. The mixing time may be adjustable. In some embodiments, mixer 50 is configured to selectively mix the first and second materials to create one or more of the materials disclosed in U.S. Patent Application No. 62/533,920. In some embodiments, mixer 50 is configured to selectively mix the first and second materials to create a blend that includes a selected percentage of the first material and a selected percentage of the second material. In some embodiments, mixer 50 mixes the first and second materials such that the opened fibers form a fiber network with the foam of second material suspended within the fiber network. In some embodiments, mixer 50 includes one or a plurality of flaps that are configured to dispense the blend into a transfer gate of mixer 50, as discussed herein. In some embodiments, the transfer gate is perforated, as discussed herein. In some embodiments, duct 56 is connected to a perforated panel of mixer 50, as discussed herein. In some embodiments, mixer 50 includes spaced apart load cells that provide a feedback loop to electrical cabinet 106 to stop filling material when a target weight is achieved. The mixing system will mix the materials for a predetermined amount of time only after the materials have been filled to the target weights.

Component 42 includes a silo 72 that is connected to mixer 50 by a tube, such as, for example, a duct 74 and a tube, such as, for example, a duct 76. A fiber blower 78 is positioned between duct 74 and duct 76. Fiber blower 78 includes a fan or blower configured to draw the material that is blended by mixer 50 through duct 74 and move the blended material through duct 76 and into silo 72. Silo 72 is connected to a fiber blower 80 by a tube, such as, for example, a duct 82. In some embodiments, an airline positioned within duct 82 to blow air into the duct to move the blended material through duct 82 to fiber blower 80, as discussed herein.

Fiber blower 80 of component 42 is connected to a component 84 of system 20 by a tube, such as, for example, a duct 86. In some embodiments, duct 86 is connected to a connector 88 of component 84. In some embodiments, connector 88 is a 3-way valve that is operated by pneumatics to control material flow from components 22, 42, 108. Connector 88 may be configured to move material from one of components 22, 42, 108 to component 84. That is, connector 88 cannot move material from each of components 22, 42, 108 at once. Connector 88 is connected to an electrical weighing system, such as, for example, weighing system 90 by a tube, such as, for example, a duct 92. Weighing system 90 is configured to weigh the material that is blended by mixer 50 so that a selected amount of the material can be disposed in a pillow cover or shell, as discussed herein. In some embodiments, component 84 includes an electrical cabinet 85 that includes electronic components that communicate with weighing system 90. In some embodiments, electrical cabinet 85 includes a circuit overload that communicates with an electrical cabinet 106, as discussed herein. If electrical cabinet 106 detects a problem in system 20, an operator may check electrical cabinet 85 to see if the problem is within component 84 or within another component of system 20. In some embodiments, weighing system 90 may include one more sensors to determine when weighing system 90 is full and when weighing system 90 is not full. System 20 can be configured to send a signal from weighing system 90 to silo 72 to prevent more material being sent to weighing system 90 when weighing system 90 is full. System 20 may also be configured to send a signal from weighing system 90 to silo 72 so that more material to be sent to weighing system 90 when weighing system 90 is not full. For example, system 20 may turn fiber blower 80 off when weighing system 90 is full and may turn fiber blower 80 on when weighing system is not full.

Weighing system 90 of component 84 is connected to a tube, such as, for example, a duct 94 of a component 96 of system 20 by a reducer 98, as shown in FIG. 1. Component 96 includes a fiber blower 100 that includes a fan or blower configured to draw the selected amount of material that is weighed by weighing system 90 through reducer 98 and move the material through duct 94 and into one of two vacuum filling cabinets, such as, for example, fillers 102. Each filler 102 includes a plurality of nozzles 104. Fillers 102 are configured to move the selected amount of material that is weighed by weighing system 90 through one of nozzles 104 and into a pillow cover or shell. In some embodiments, fillers 102 may be configured to sequentially move the selected amount of material that is weighed by weighing system 90 through nozzles 104. That is, fillers 102 may be configured to move a first selected amount of material that is weighed by weighing system 90 through a first one of nozzles 104, then move a second selected amount of material that is weighed by weighing system 90 through a second one of nozzles 104, then move a third selected amount of material that is weighed by weighing system 90 through a third one of nozzles 104, and then move a fourth selected amount of material that is weighed by weighing system 90 through a fourth one of nozzles 104. This allows an operator to sequentially fill pillow covers or shells using each of nozzles 104. In some embodiments, component 96 includes an electrical cabinet 106 that includes electronic components that communicate with fillers 102.

Figure 5:
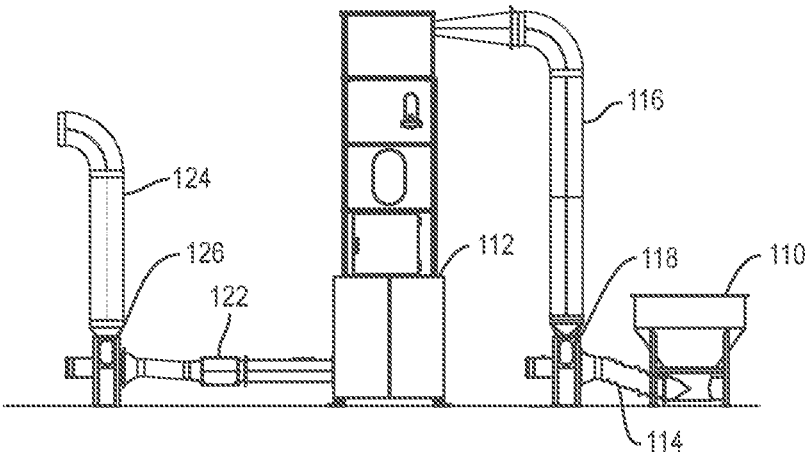
FIG. 5 is a side view of components of the filling system shown in FIG. 1.

As discussed above, system 20 may be used to blend and/or mix two or more distinct materials and then fill pillow covers or shells with the blended/mixed materials. In some embodiments, system 20 may be used to fill pillow covers or shells with a single material, such as, for example, one of the materials discussed herein. System 20 may include a component 108 having a funnel 110, as shown in FIGS. 1 and 5. Funnel 110 is configured for disposal of the single material and is connected to a silo 112 by tubes, such as, for example, ducts 114, 116. A fiber blower 118 is positioned between ducts 114, 116 and includes a fan or blower configured to draw the single material through funnel 110 and duct 114 and move the material through duct 116 and into silo 112. Silo 112 is connected to a connector 120 of component 108 by tubes, such as, for example, ducts 122, 124. A fiber blower 126 is positioned between ducts 122, 124 and includes a fan or blower configured to draw the single material in silo 112 through duct 122 and move the material through duct 124 and into connector 120. Connector 120 is connected to connector 88 such that fiber blower 126 can move the single material from connector 120 and into connector 88. System 20 can be configured to send a signal from weighing system 90 to silo 112 to prevent more material being sent to weighing system 90 when weighing system 90 is full. System 20 may also be configured to send a signal from weighing system 90 to silo 112 so that more material to be sent to weighing system 90 when weighing system 90 is not full. For example, system 20 may turn fiber blower 126 off when weighing system 90 is full and may turn fiber blower 126 on when weighing system 90 is not full.

The single material moves from connector 88 to weighing system 90 through duct 92. Weighing system 90 is configured to weigh the single material that was loaded into funnel 110 so that a selected amount of the material can be disposed in a pillow cover or shell, as discussed herein. Fiber blower 100 draws the selected amount of material that is weighed by weighing system 90 through reducer 98 and moves the material through duct 94 and into one of fillers 102. Filler 102 moves the material through one of nozzles 104 and into a pillow cover or shell. This allows system 20 to be used to fill pillow covers or shells with a single material, such as, for example, one of the materials discussed herein. Alternatively, one or more materials, such as, for example, one or more of the materials discussed herein can be loaded into funnel 110 to fill pillow covers or shells without using components 22, 42. If desired, system 20 can be used to combine one or more of the materials that are loaded into funnel 110 with the material discussed above that is blended by mixer 50 such that pillow covers or shells can be filled with a combination of the materials that are loaded into funnel 110 and the material that is blended by mixer 50. That is, components 22, 42 can deliver the material discussed above that is blended by mixer 50 to weighing system 90 and component 108 can deliver the material or materials that is/are loaded into funnel 110 to weighing system 90. Weighing system 90 can then weigh a selected amount of the materials and then send the materials to one of fillers 102 to fill a pillow case or cover with the materials. In some embodiments, weighing system 90 is configured to mix the material discussed above that is blended by mixer 50 with the material or materials that is/are loaded into funnel 110.

Figure 6:
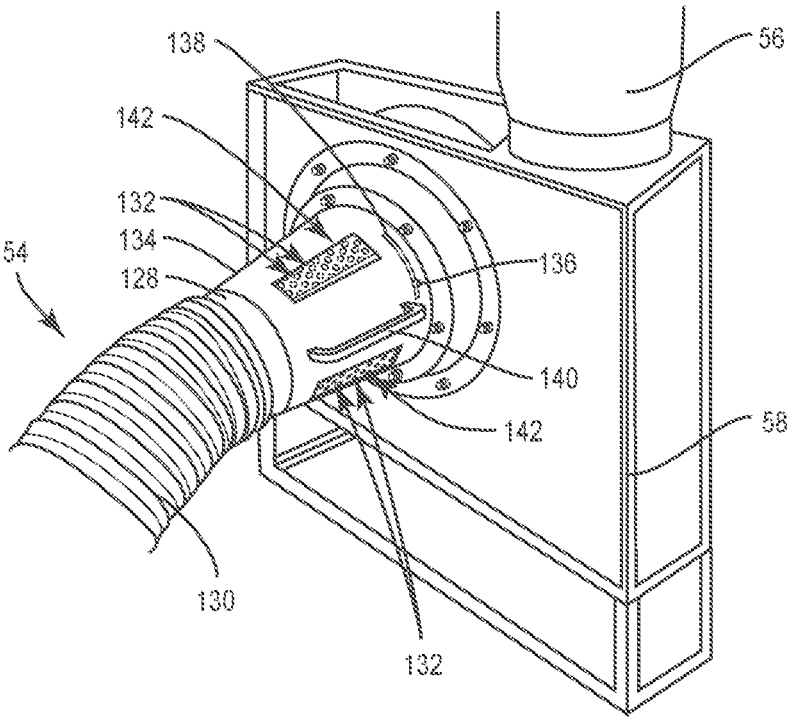
FIG. 6 is a perspective view of components of the filling system shown in FIG. 1.

In some embodiments, duct 54 includes a rigid portion 128 that is directly connected to fiber blower 58 and a flexible portion 130 that is directly connected to rigid portion 128, as shown in FIG. 6. Rigid portion 128 includes spaced apart perforations 132 that each extend through the thickness of rigid portion 128. Perforations 132 are configured to pull ambient air into duct 54 without allowing the second material to escape. This increases the airflow required for high density materials. In some embodiments, perforations 132 extend along the entire length of rigid portion 128. In some embodiments, perforations 132 extend along only a portion of the length of rigid portion 128. Perforations 132 are arranged in groups that are separated from one another by solid portions of rigid portion 128 that do not include any perforations.

In some embodiments, duct 54 includes an airflow adjustment sleeve 134 that is fitted over a portion of rigid portion 128, as shown in FIG. 6. Sleeve 134 is rotatable relative to rigid portion 128. Rigid portion 128 includes a pin 136 that extends through a slot 138 of sleeve 134. Slot 138 includes opposite first and second ends that define limits of rotation for sleeve 134. That is, sleeve 134 can be rotated in a first direction until pin 136 contacts an inner surface of sleeve 134 that defines the first end of slot 138 and an opposite second direction until pin 136 contacts an inner surface of sleeve 134 that defines the second end of slot 138. Sleeve 134 includes a handle 140 configured for gripping to facilitate rotation of sleeve 134 relative to rigid portion 128. Sleeve 134 includes a plurality of spaced apart windows 142 that each extend through the thickness of sleeve 134. Windows 142 are spaced apart from one another by solid portions of sleeve 134. Sleeve 134 may be rotated relative to rigid portion 128 to change the amount of perforations 134 that are covered by the solid portions of sleeve 134 to change the amount of ambient air that is pulled into duct 54 through windows 142 and perforations 132. For example, sleeve 134 can be rotated relative to rigid portion 128 between a first orientation in which the solid portions of sleeve 134 cover all or a first amount of perforations 132 a second orientation the solid portions of sleeve 134 cover none or a reduced second amount of perforations 132 to increase the amount of ambient air that is pulled into duct 54 through windows 142 and perforations 132. Sleeve 134 can then be rotated relative to rigid portion 128 to move sleeve 134 from the second orientation to the first orientation to decrease the amount of ambient air that is pulled into duct 54 through windows 142 and perforations 132.

Figure 7:
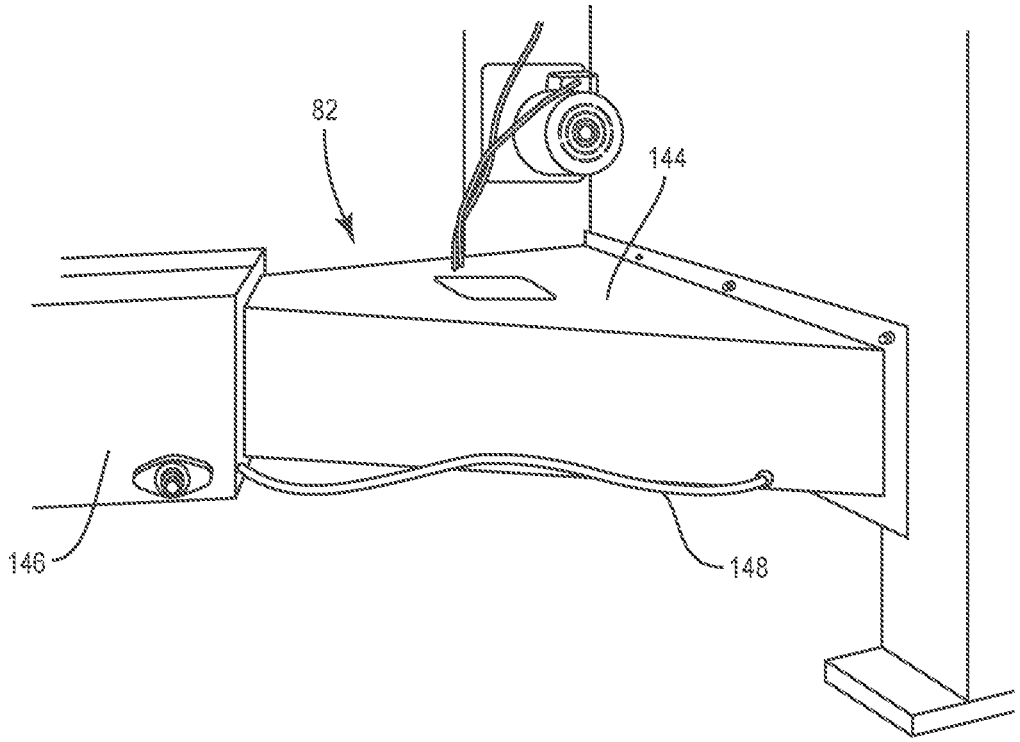
FIG. 7 is a perspective view of components of the filling system shown in FIG. 1.
Figure 8:
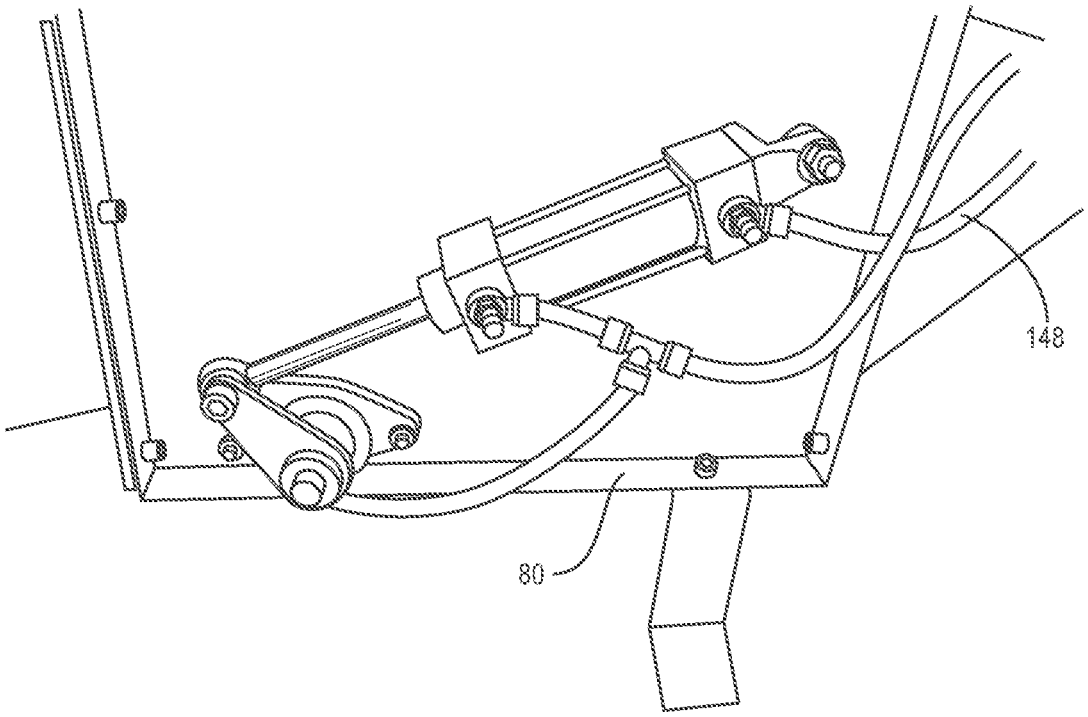
FIG. 8 is a perspective view of components of the filling system shown in FIG. 1.

In some embodiments, duct 82 includes a tapered reducer 144 that is directly connected to silo 78 and a straight portion 146 that extends from reducer 144 to fiber blower 80, as shown in FIG. 7. An airline 148 is positioned within reducer 144 to blow air into duct 82 to move the blended material through duct 82 to fiber blower 80. The air added by air line 148 allows system 20 to generate enough airflow to pneumatically convey the blend of materials mixed by mixer 50 from silo 78 to fiber blower 80. In some embodiments, air line 148 is configured to produce bursts of air that will loosen and move the blend of materials mixed by mixer 50 from silo 78 to fiber blower 80. In some embodiments, air line 148 is configured to produce a continuous stream of air that will move the blend of materials mixed by mixer 50 from silo 78 to fiber blower 80. In some embodiments, air line 148 extends from fiber blower 80, as shown in FIG. 8.

Figure 9:
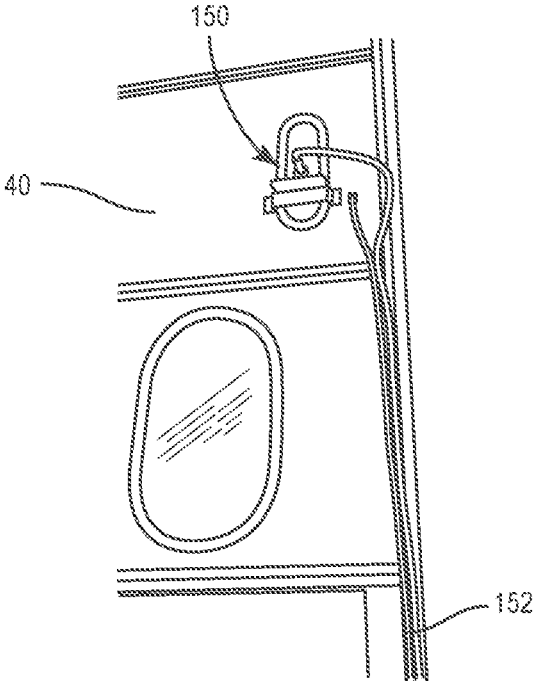
FIG. 9 is a perspective view of components of the filling system shown in FIG. 1.
Figure 10:
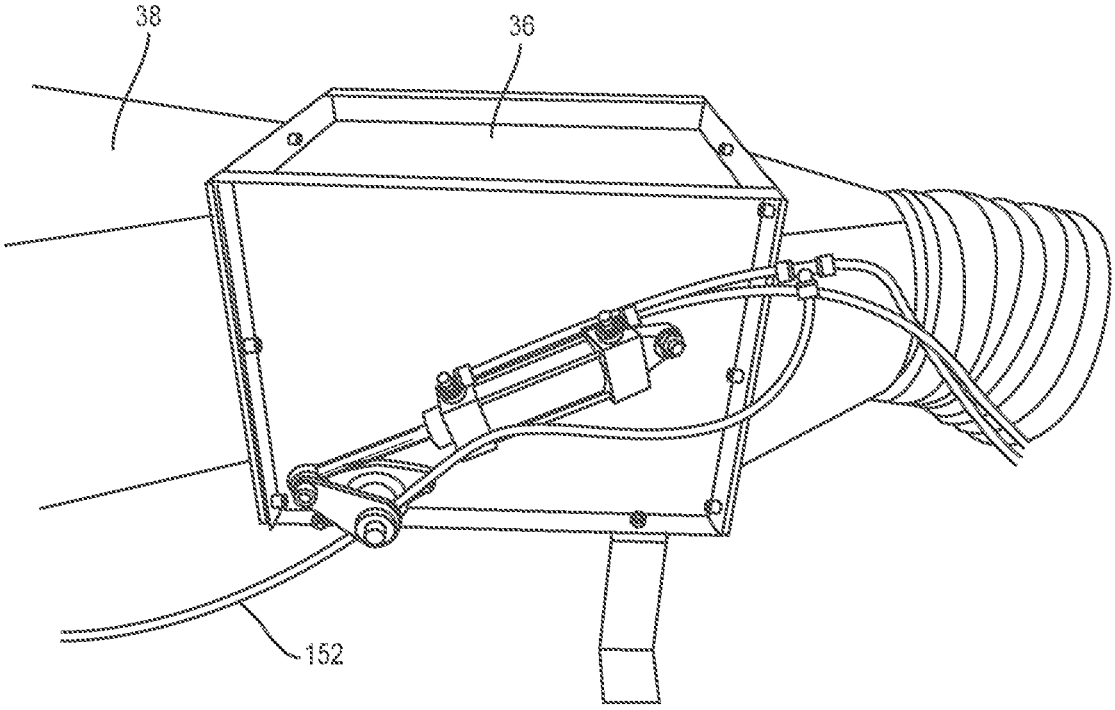
FIG. 10 is a perspective view of components of the filling system shown in FIG. 1.

In some embodiments, silo 40 includes a photo eye 150 having a sensor that is positioned within silo 40 to sense when silo 40 is full, as shown in FIG. 9. An airline 152 is positioned within silo 40 adjacent to the sensor of photo eye 150 to provide an air supply configured to blow the fibers that are opened by fiber opener 30 away from the sensor of photo eye 150 when silo 40 is not full. In some embodiments, air line 152 extends from fiber blower 36, as shown in FIG. 10. In some embodiments, system 20 can be configured to send a signal from silo 40 to bale opener 24 and/or fiber opener 30 to shut bale opener 24 and/or fiber opener 30 off if and when photo eye 150 senses that silo 40 is full. This will prevent more material being sent to silo 40 when silo 40 is full. System 20 may also be configured to send a signal from silo 40 to bale opener 24 and/or fiber opener 30 to turn bale opener 24 and/or fiber opener 30 on if and when photo eye 150 senses that silo 40 is not full. This will allow more material to be sent to silo 40 when silo 40 is not full.

Figure 11:
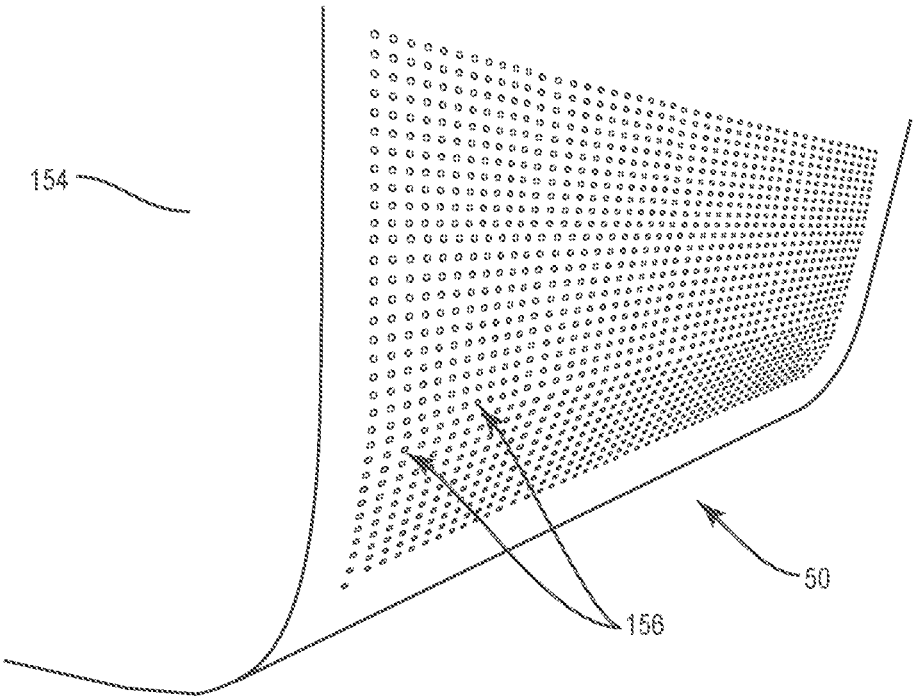
FIG. 11 is a perspective view of a component of the filling system shown in FIG. 1.
Figure 12:
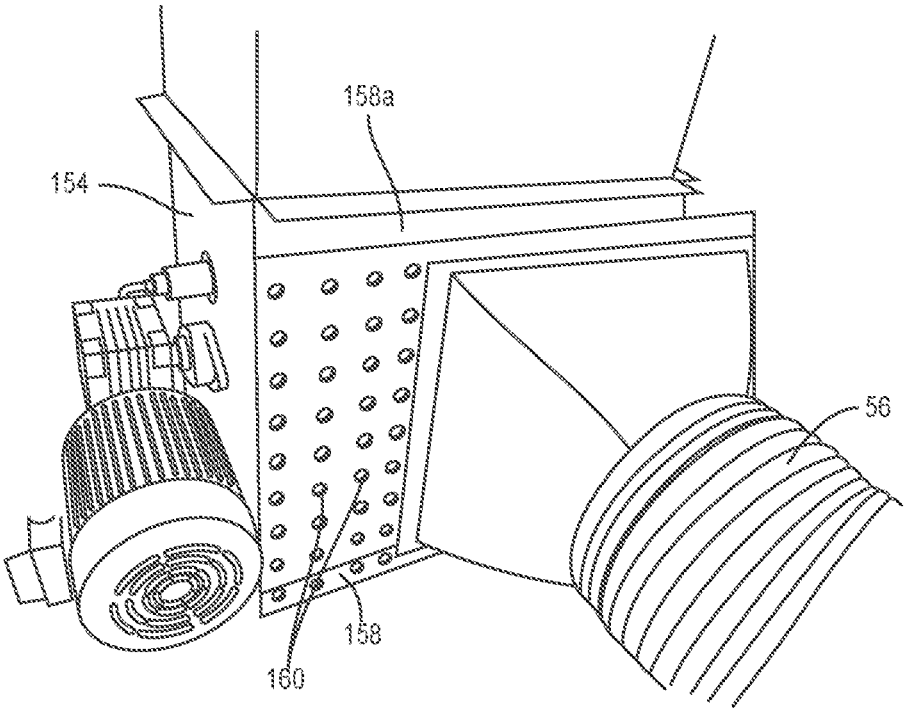
FIG. 12 is a perspective view of components of the filling system shown in FIG. 1.
Figure 13:
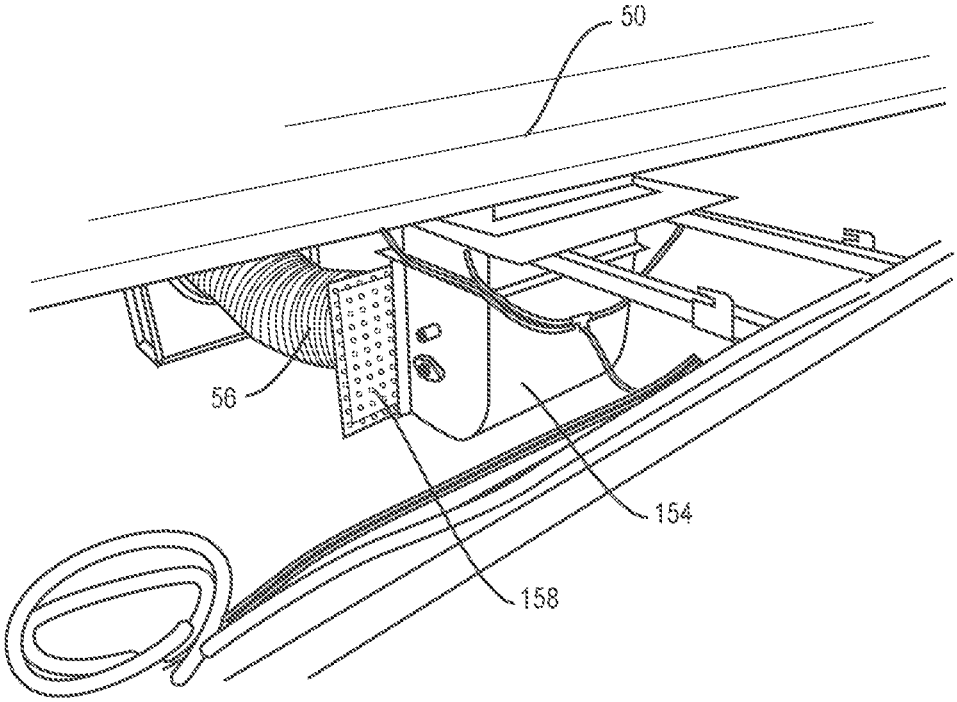
FIG. 13 is a perspective view of components of the filling system shown in FIG. 1.
Figure 14:
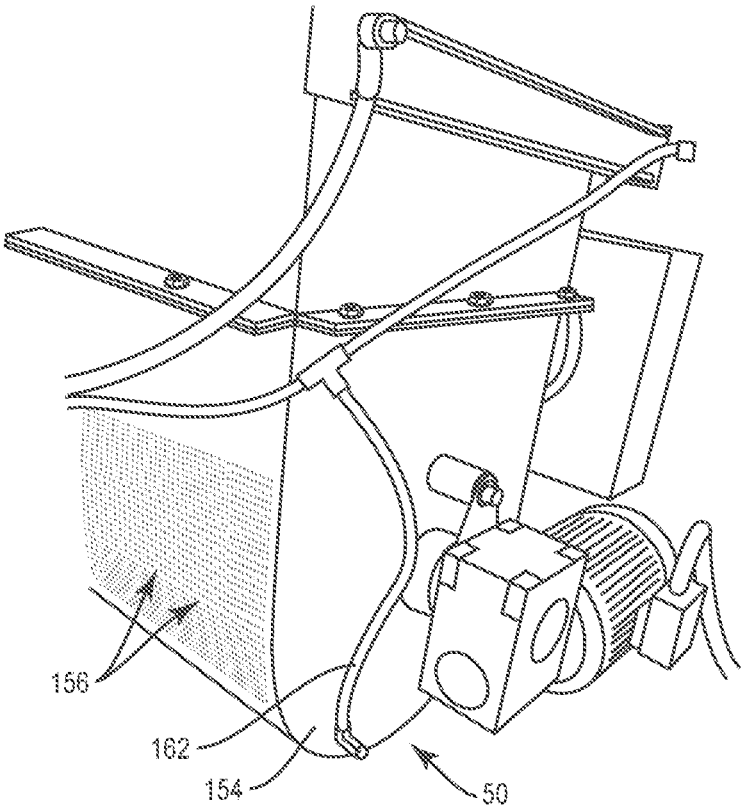
FIG. 14 is a perspective view of components of the filling system shown in FIG. 1.

In some embodiments, mixer 50 includes a transfer gate 154 that includes a plurality of spaced apart perforations 156, as shown in FIG. 11. Perforations 156 ambient air to be drawn into transfer gate 154 to allow one or more materials within mixer 50 to freely flow within mixer 50. In some embodiments, an end of duct 56 is connected to a panel 158 of mixer 50, as shown in FIG. 12. Panel 158 includes a first portion 158*a* that is directly attached to transfer gate 154, as shown in FIG. 12, and a second portion 158*b* that extends outwardly from transfer gate 154, as shown in FIG. 13. Panel 158 includes a plurality of spaced apart perforations 160 that allow one or more materials within mixer 50 to freely flow through mixer 50. In some embodiments, portions 158*a*, 158*b* each include perforations 160. In some embodiments, only one of portions 158*a*, 158*b* includes perforations 160. In some embodiments, panel 158 is made of a transparent or translucent material, such as, for example, plexiglass, to make the material(s) within transfer gate 154 viewable. In some embodiments, mixer 50 includes an airline 162, as shown in FIG. 14. Air line 162 is configured to provide an air supply into transfer gate 154 to break up one more materials within transfer gate 154.

Figure 15:
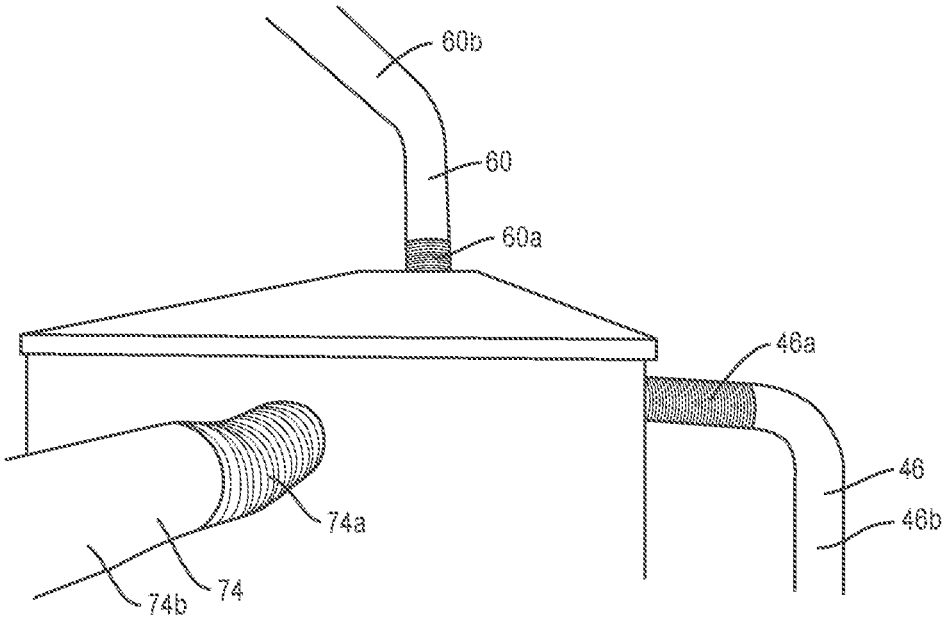
FIG. 15 is a perspective view of components of the filling system shown in FIG. 1.

In some embodiments, mixer 50 is configured to weigh one or more materials, such as, for example, one or more of the materials discussed herein. In some embodiments, duct 46 includes a flexible portion 46*a* that is directly connected to mixer 50 and a rigid portion 46*b* that is connected to flexible portion 46*a*; duct 60 includes a flexible portion 60*a* that is directly connected to mixer 50 and a rigid portion 60*b* that is connected to flexible portion 60*a*; and duct 74 includes a flexible portion 74*a* that is directly connected to mixer 50 and a rigid portion 74*b* that is connected to flexible portion 74*a*, as shown in FIG. 15. Flexible portions 46*a*, 60*a*, 74*a* are configured to reduce or eliminate external forces that can negatively affect the accuracy of mixer 50 as mixer 50 weighs one or more materials. In some embodiments, flexible portions 46*a*, 60*a*, 74*a* suspend mixer 50 freely above load cells to allow the load cells to accurately weigh one or more materials, such as, for example, one or more of the materials discussed herein.

Figure 16:
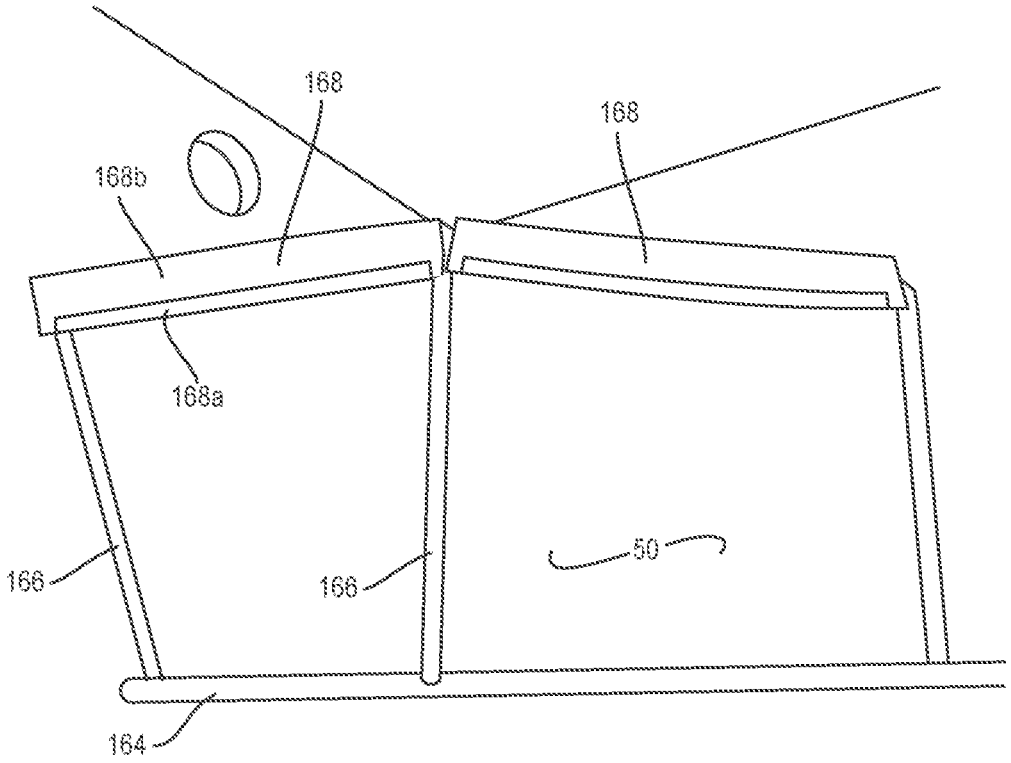
FIG. 16 is a perspective view of components of the filling system shown in FIG. 1.

In some embodiments, mixer 50 includes an axle, such as, for example an arm 164 positioned within mixer 50, as shown in FIG. 16. Mixer 50 includes an actuator, such as, for example, a motor that is coupled to arm 164 to allow arm 164 to rotate within a chamber of mixer 50. In some embodiments, the motor is configured to rotate arm 164 in a first direction and an opposite second direction. A plurality of rods 166 extend from arm 164 such that rods 166 are spaced apart from one another along arm 164. In some embodiments, adjacent rods 166 may be connected to one another by a flap 168. In some embodiments, mixer 50 includes a plurality of spaced apart flaps 168 wherein each of flaps is connected to two rods 166. In some embodiments, mixer 50 includes only one flap 168 that is connected to more than two rods 166. As arm 164 rotates within mixer 50, flaps 168 scrape against one or more inner wall of mixer 50 to disengage any material that is clung to the inner walls and dispense the material into transfer gate 154. In some embodiments, flaps 168 each include a rigid portion 168*a* that is connected to rods 166 and a flexible portion 168*b* that extends from rigid portion 168. In some embodiments, rigid portions 168*a* are made from metal, such as, for example, reinforced metal to securely attach flaps 168 to rods 166. In some embodiments, flexible portions 168*b* are made from a flexible material, such as, for example, nylon or rubber to prevent flaps 168 from damaging the inner walls of mixer 50.

Figure 17:
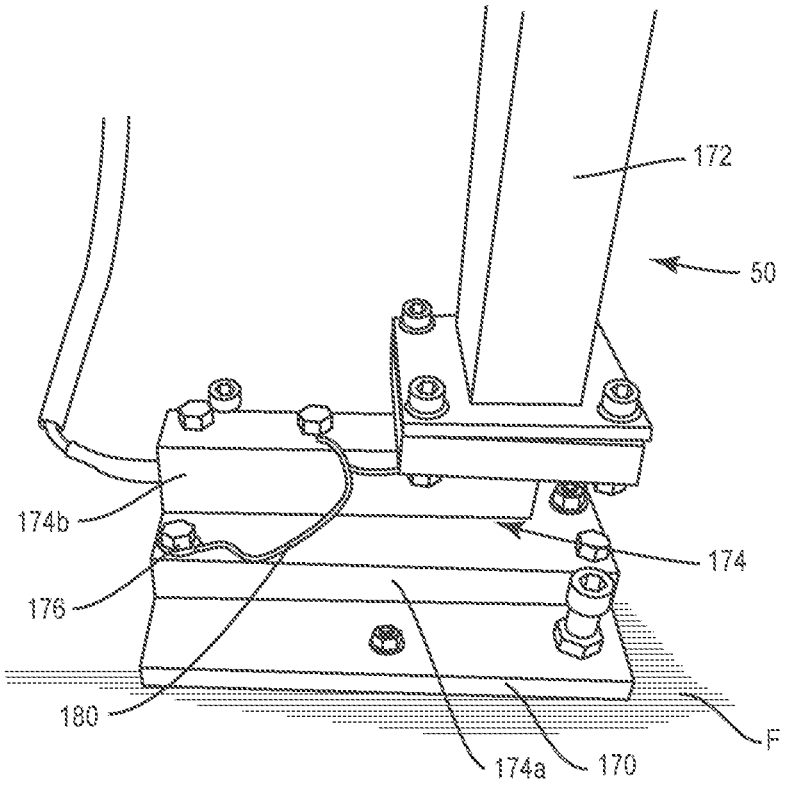
FIG. 17 is a perspective view of components of the filling system shown in FIG. 1.

In some embodiments, a leg 172 of mixer 50 is coupled to a floor F of a building or other structure by a bracket 170, as shown in FIG. 17. A load cell 174 is positioned between bracket 170 and leg 172. In some embodiments, mixer 50 includes a plurality of legs 172 that each include a load cell, such as, for example, one of load cells 174. Load cells 174 are configured to weigh material within the chamber of mixer 50. In some embodiments, load cell 174 includes a first plate 174*a* that is coupled to bracket 170 and a second plate 174*b* that is positioned between plate 174 and leg 172. A fastener, such as, for example, a bolt 176 may extend through plate 174*a* and into floor F. A fastener, such as, for example, a bolt 178 may extend into plate 174*b*. Bolts 176, 178 may be connected to one another by a wire, such as, for example, a ground wire 180. Ground wire 180 is configured to discharge any electrostatic charge generated by one or more materials within mixer 50. Discharging the electrostatic charge prevents any unwanted effects on the accuracy of the information being transferred to a weighing instrument of mixer 50.

Figure 18:
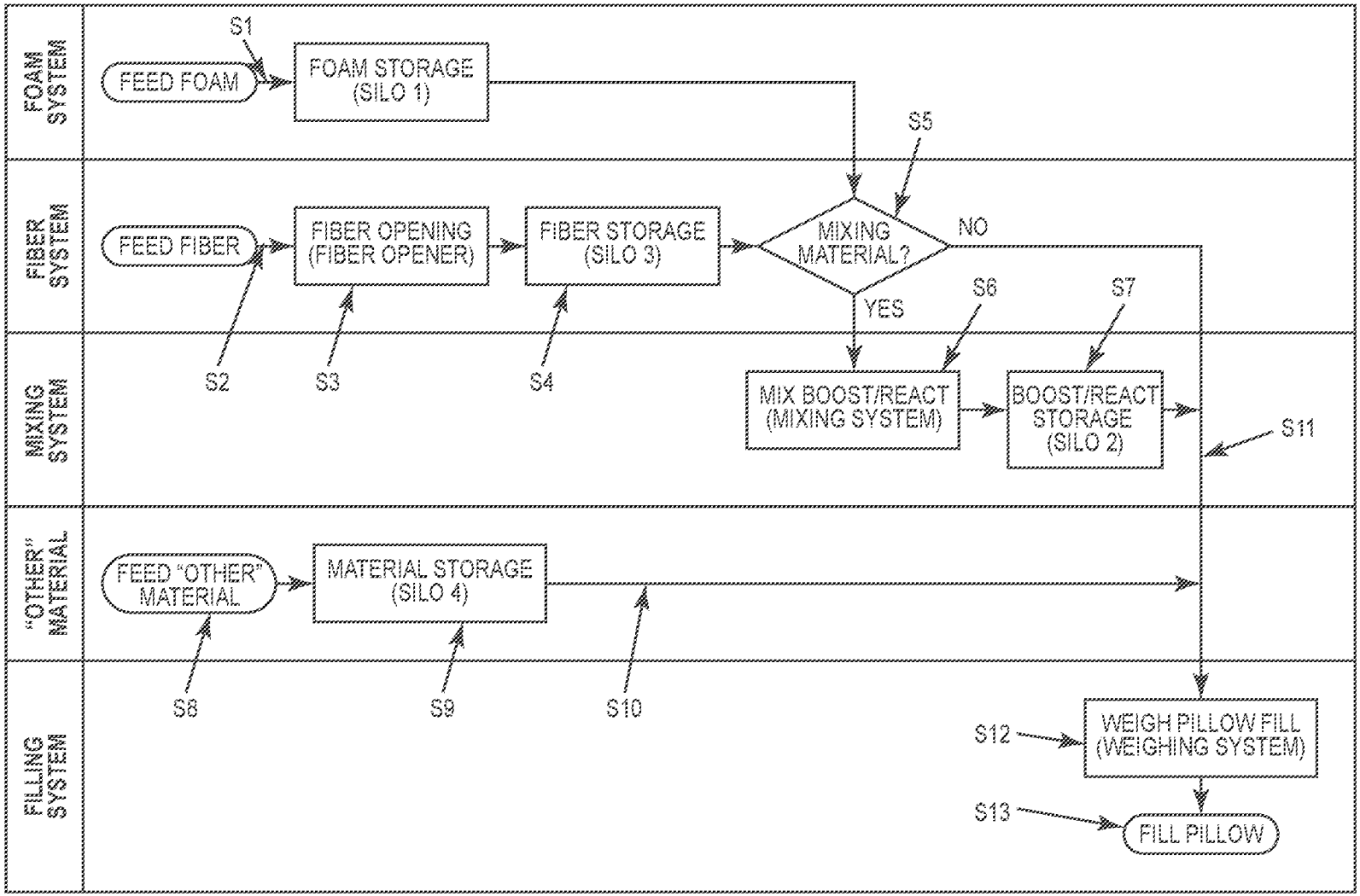
FIG. 18 is a chart showing the operation of the filling system shown in FIG. 1.

In operation and use, a first material, such as, for example, a foam material is fed or loaded into silo 52 to store the first material, as shown in step S1 in FIG. 18. A selected amount of the first material in silo 52 is moved through ducts 54, 56 and into mixer 50 by blowers 58, 60, as discussed herein. In some embodiments, the first material is cut and/or shredded into chunks prior to being fed into silo 52. In some embodiments, the chunks are cut to have a diameter between about 1.0 inch and about 1.5 inches. In some embodiments, the chunks have a density between 1.8 lbs./ft$^3$ and 4.8 lbs./ft$^3$. In some embodiments, the first material comprises latex, polyurethane and/or viscoelastic polyurethane.

A second material, such as, for example, a fiber material is fed or loaded onto conveyor belt 26. Conveyor belt 26 moves the second material to bale opener 24 at step S2. The second material moves from bale opener 24 to fiber opener 30 at step S3 to open the fibers of the second material, as discussed herein. In some embodiments, fiber opener 30 opens the fibers to space the fibers apart from other fibers. For example, fibers opener 30 can be open the fibers by blowing air to separate the fibers. The opened fibers are moved from bale opener 24 to silo 40 at step S4, where the opened fibers are stored. A selected amount of the second material in silo 40 is moved through ducts 44, 46 and into mixer 50 by blowers 36, 48 in step S5. In some embodiments, the second material comprises polyester fibers. In some embodiments, the second material has a denier between about 0.9 D and about 2.8 D.

Mixer 50 mixes the first and second materials at step S6 to create a blend having a selected amount of the first material and a selected amount of the second material. In some embodiments, mixer 50 mixes the first and second materials such that the opened fibers of the second material form a fiber network with the foam of first material suspended within the fiber network. The blend is moved from mixer 50 and into silo 72 at step S7. In some embodiments, the second material is treated to maintain the first material within the fiber network created by the second material. For example, the second material may be coated with a siliconized material and/or can comprise a siliconized material. It is envisioned that the siliconized material maintains contact between the second material and the first material to maintain the first material within the fiber network created by the second material.

In some embodiments, a third material, such as, for example, one or more of the materials discussed herein is fed or loaded into funnel 110 at step S8. The third material is moved through ducts 114, 116 and into silo 112 by blower 118 at step S9. A selected amount of the third material in silo 112 is moved through ducts 122, 124, 92, 98 to weighing system 90 at step S10. A selected amount of the blend of the first and second materials in silo 72 is moved through ducts 82, 86, 92 and into weighing system 90 at step S11. In some embodiments, step S11 occurs before and/or after step S10. In some embodiments, steps S10 and S11 occur simultaneously. In some embodiments, system 20 can be programmed to perform steps S10, S11 using electrical cabinet 106. In some embodiments, system 20 can be programmed such that weighing system 90 includes a selected amount of the blend of the first and second materials and a selected amount of the third material. For example, system 20 can be programmed such that weighing system 90 includes a certain percentage of the blend of the first and second materials and a certain percentage of the third material.

The blend of the first and second materials and the third material are weighed by weighing system 90 at step S12. A selected amount of the blend of the first and second materials and the third material is moved from weighing system 90 and into filler 102, which fills a pillow case or shell with the selected amount of the blend of the first and second materials and the third material at step S13. In some embodiments, steps S12 and S13 are repeated one or a plurality of times to fill a plurality of pillow cases or shells. In some embodiments, weighing system 90 may be configured to store enough of the blend of the first and second materials and the third material to fill a plurality of pillow cases or shells. In such embodiments, steps S12 and S13 can be repeated without repeating steps S10 and S11. In some embodiments, weighing system 90 may be configured to store only enough of the blend of the first and second materials and the third material to fill one pillow case or shell. In such embodiments, steps S10, S11, S12 and S13 are each repeated each time a pillow case or shell is filled.

In some embodiments, system 20 may be used to fill a pillow case or shell with only the blend of the first and second materials from mixer 50. In such embodiments, steps S8-S10 are omitted. That is, the method goes directly from step S7 to step S11. A selected amount of the blend of the first and second materials in silo 72 is moved through ducts 82, 86, 92 to weighing system 90 and into weighing system 90 at step S11. The blend of the first and second materials is weighed by weighing system 90 at step S12. A selected amount of the blend of the first and second materials is moved from weighing system 90 and into filler 102, which fills a pillow case or shell with the selected amount of the blend of the first and second materials at step S13. In some embodiments, steps S12 and S13 are repeated one or a plurality of times to fill a plurality of pillow cases or shells. In some embodiments, weighing system 90 may be configured to store enough of the blend of the first and second materials to fill a plurality of pillow cases or shells. In such embodiments, steps S12 and S13 can be repeated without repeating step S10. In some embodiments, weighing system 90 may be configured to store only enough of the blend of the first and second materials to fill one pillow case or shell. In such embodiments, steps S11, S12 and S13 are each repeated each time a pillow case or shell is filled.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A filling system comprising:

a first component comprising a fiber opener configured to open fibers;

a second component connected to the first component, the second component comprising a fiber blower configured to blow opened fibers;

a third component connected to the second component, the third component comprising a weighing system configured to weigh the opened fibers;

a fourth component connected to the third component, the fourth component comprising a filler configured to dispose the opened fibers into a shell; and a silo positioned between the first component and the second component, the silo comprising a photo eye configured to sense when the silo is full and an air supply configured to blow the opened fibers away from the photo eye when the silo is not full.

2. A filling system as recited in claim 1, wherein the first component comprises a conveyor belt configured to move a bale of fibers to the fiber opener.

3. A filling system as recited in claim 1, wherein the fiber blower comprises a first fiber blower and a second fiber blower that is spaced apart from the first fiber blower by the silo.

4. A filling system as recited in claim 3, further comprising a tube having a first end that is connected to the second fiber blower and a second end that is connected to the silo, the first end comprising perforations configured to pull ambient air into the tube.

5. A filling system as recited in claim 3, further comprising a tube having a first end that is connected to the second fiber blower and a second end that is connected to the silo, the first end comprising an airflow adjustment sleeve configured to control the amount of ambient air that is pulled into the tube.

6. A filling system as recited in claim 3, further comprising a tube having a first end that is connected to the second fiber blower and a second end that is connected to the silo, the first end comprising perforations and an airflow adjustment sleeve configured to change the amount of the perforations that are exposed to ambient air to control the amount of ambient air that is pulled into the tube.

7. A filling system as recited in claim 3, further comprising:

a duct positioned between the second fiber blower and the silo; and an airline positioned within the duct to blow air into the duct to move the opened fibers through the duct to the second fiber blower.

8. A filling system as recited in claim 1, wherein the fiber blower comprises a first fiber blower and a second fiber blower that is spaced apart from the first fiber blower by a mixer that is configured to mix the opened fibers.

9. A filling system as recited in claim 8, wherein the mixer comprises a perforated transfer gate.

10. A filling system as recited in claim 8, further comprising a duct having a first end that is connected to the first fiber blower and a second end that is connected to a perforated panel of the mixer.

11. A filling system as recited in claim 8, wherein the first fiber blower by a first duct and the second fiber blower is connected to the mixer by a second duct, the ducts each comprising a flexible end that is connected to the mixer to allow the flexible ends to move relative to the mixer.

12. A filling system as recited in claim 8, wherein the mixer includes a chamber and flaps positioned within the chamber, the flaps being configured to rotate within the chamber to move the opened fibers within the chamber.

13. A filling system as recited in claim 8, wherein the mixer includes a ground wire configured to discharge any electrostatic charge within the mixer.

14. A filling system as recited in claim 1, further comprising a mixer, wherein the fiber blower comprises a first fiber blower, a second fiber blower and a third fiber blower, the second fiber blower being spaced apart from the first fiber blower by the mixer, the third fiber blower being spaced apart from the second fiber blower by the silo.

15. A filling system as recited in claim 1, further comprising a mixer, wherein the silo includes a first silo and a second silo, the fiber blower comprising a first fiber blower, a second fiber blower, a third fiber blower and a fourth fiber blower, the second fiber blower being spaced apart from the first fiber blower by the first silo, the third fiber blower being spaced apart from the second fiber blower by a mixer, the fourth fiber blower being spaced apart from the third fiber blower by the second silo.

16. A filling system as recited in claim 1, further comprising a blower positioned between the third component and the fourth component.

17. A filling system as recited in claim 1, wherein the filler comprises a vacuum filling cabinet and a plurality of nozzles that are connected to the cabinet.

18. A filling system as recited in claim 1, wherein the filler comprises a first vacuum filling cabinet, a second vacuum filling cabinet, a plurality of nozzles that are connected to the first vacuum filling cabinet and a plurality of nozzles that are connected to the second vacuum filling cabinet.

19. A filling system comprising:

a first component comprising a fiber opener configured to open fibers;

a mixer configured to mix the opened fibers;

a second component connected to the first component, the second component comprising a fiber blower configured to blow opened fibers, the fiber blower comprising a first fiber blower and a second fiber blower that is spaced apart from the first fiber blower by the mixer, the first fiber blower being connected to the mixer by a first duct and the second fiber blower being connected to the mixer by a second duct, the ducts each comprising a flexible end that is connected to the mixer to allow the flexible ends to move relative to the mixer;

a third component connected to the second component, the third component comprising a weighing system configured to weigh the opened fibers; and a fourth component connected to the third component, the fourth component comprising a filler configured to dispose the opened fibers into a shell.

20. A filling system comprising:

a first component comprising a fiber opener configured to open fibers;

a mixer configured to mix the opened fibers;

a silo;

a second component connected to the first component, the second component comprising a fiber blower configured to blow opened fibers, the fiber blower comprising a first fiber blower, a second fiber blower and a third fiber blower, the second fiber blower being spaced apart from the first fiber blower by the mixer, the third fiber blower being spaced apart from the second fiber blower by the silo;

a third component connected to the second component, the third component comprising a weighing system configured to weigh the opened fibers; and a fourth component connected to the third component, the fourth component comprising a filler configured to dispose the opened fibers into a shell.

* * * * *